US005398475A

United States Patent [19]

Kraus

[11] Patent Number: 5,398,475

[45] Date of Patent: Mar. 21, 1995

[54] JOINT-ADAPTER FOR DOUBLY CURVED LATTICE GIRDERS, IN PARTICULAR SINGLE-LAYER TYPES

[75] Inventor: Paul Kraus, Altertheim, Germany

[73] Assignee: Mero-Raumstruktor, Wurzburg, Germany

[21] Appl. No.: 80,217

[22] Filed: Jun. 23, 1993

[30] Foreign Application Priority Data

Jun. 25, 1992 [DE] Germany ..... 42 24 663.6

[51] Int. Cl.[6] ..... E04H 12/00

[52] U.S. Cl. ..... 52/655.1; 52/646

[58] Field of Search ..... 52/655.1, 646; 403/217, 403/218

[56] References Cited

U.S. PATENT DOCUMENTS 5,305,571 4/1994 Trevino ..... 52/655.1

FOREIGN PATENT DOCUMENTS 2379755 of 1978 France .
3219601 1/1983 Germany .
8433490.8U1 3/1985 Germany .
8708053.2U1 10/1988 Germany .
3801660A1 7/1989 Germany .
9204208U1 6/1992 Germany .
771275 10/1980 U.S.S.R. ..... 52/655.1

*Primary Examiner*—Carl D. Friedman
*Assistant Examiner*—Beth A. Aubrey
*Attorney, Agent, or Firm*—Frank P. Presta

[57] ABSTRACT

In order to manufacture joint-adapters for doubly curved and preferably single-layer lattice girders with improved strength and lesser weight while at the same time also allowing relatively high curvatures of the lattice girders, the invention suggests to make the joint-adapters 11 predominantly frusto-conical. Their plane rest surfaces 22 for the butt ends of the bars 10 of the lattice girder subtend the same or substantially the same slope angle α with the extended joint-adapter main axis 16 as the residual part of the joint-adapter wall. The slope angle α of the rest surfaces 12 relative to the extended joint-adapter main axis 16 determines the curvature of the lattice girder. In the preferred embodiment mode of the invention, the wall thickness of the frusto-conical joint-adapter 11 is of constant thickness over the entire height H at its thinnest sites in the vicinity of the rest surfaces 12.

6 Claims, 4 Drawing Sheets

Figure 1:
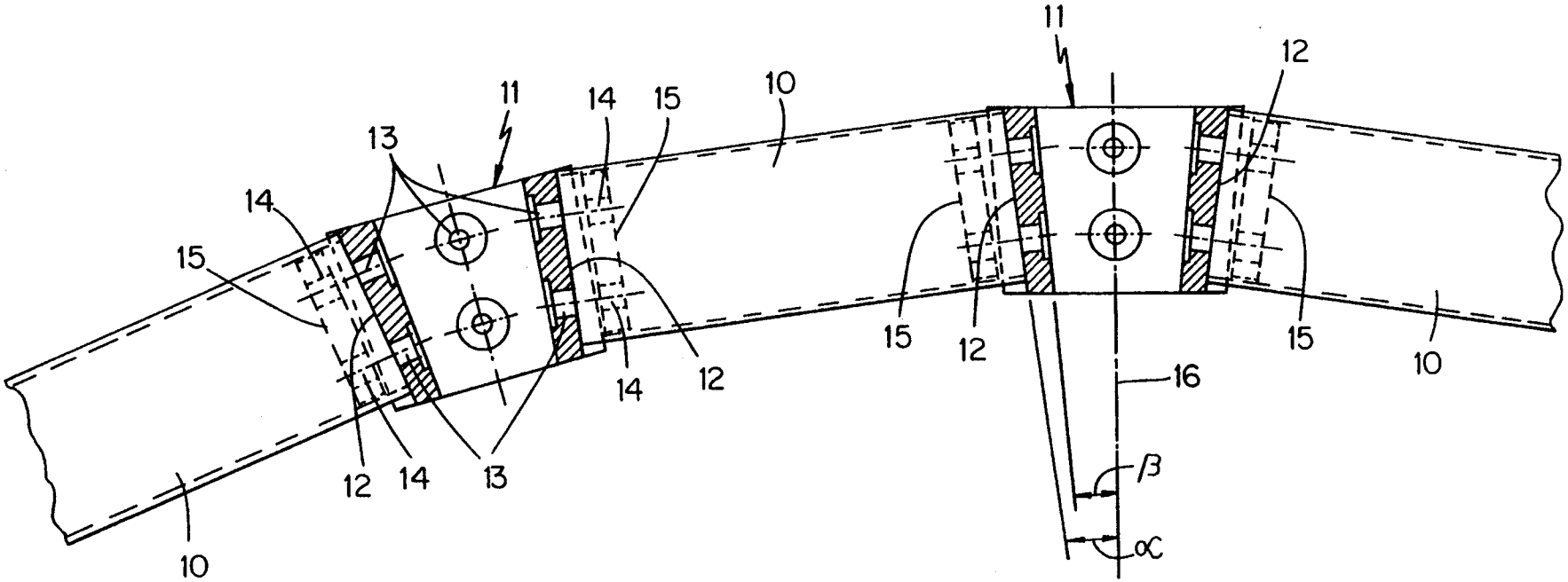

JOINT-ADAPTER FOR DOUBLY CURVED LATTICE GIRDERS, IN PARTICULAR SINGLE-LAYER TYPES

DESCRIPTION

The invention concerns a joint-adapter for doubly curved lattice girders, especially in single-layers, consisting of a hollow unit with boreholes for fastening-bolts to connect the bars of the girder lattice to the joint-adapter which comprises plane rest surfaces for the butt ends of the bars.

Such joint-adapters of the state of the art (MERO brochure D-852/1.89) consist of hollow cylinders or pipe stubs of which the rest surfaces for the butt ends of the bars are worked (milled) at an angle to the extended main axis of the hollow cylinder as a function of the curvature of the lattice girder. As a result of this method, the wall thickness of the hollow cylinder sometimes decreases substantially from top to bottom in relation to the curvature of the girder in the zone of said rest surfaces, whereby the strength of these joint-adapters is adversely affected. Accordingly hollow-cylindrical joint-adapters with large wall thicknesses are required for relatively highly curved lattice girders and thereby are uneconomical. Lastly these joint-adapters are heavy and make assembly more difficult. The above drawbacks apply equally to so called cup and saucer joint-adapters. In these variations of joint-adapters, the joint segment comprising the rest surfaces for the butt-ends of the bars also consists of a hollow cylinder. The hollow-cylinder adapters and the saucer adapters are used for single-layer lattice girders while the so-called cup adapters are designed for double-layer lattice girders.

The object of the invention is to preclude the drawbacks of the above joint-adapters and propose a more economical solution for doubly curved lattice girders furthermore especially suited for comparatively substantially curved girders.

This problem is solved by the invention in that (a) the joint-adapter predominantly is frusto-conical, and (b) the rest surfaces for the butt ends of the bars subtend the same or substantially the same angle with the extended main axis of the adapter, the slope of the rest surfaces relative to the extended adapter main axis determining the curvature of the lattice girder.

Using such joint-adapters, it is possible to economically build doubly curved lattice girders even when the curvature is high, while simultaneously the adapter strength is improved, the least wall thickness of the frusto-conical joint-adapters being constant or substantially constant along their height in the zone of the rest surfaces.

The sub-claims state embodiment modes of the invention. Illustratively the frusto-conical joint-adapter may comprise a base, whereby its strength is further improved.

In further embodiment modes of the invention, the frusto-conical joint-adapter also may be a cup or a saucer adapter.

The joint-adapters of the invention may be metallic (preferably being forged steel) or in the event of lesser requirements of strength for the lattice girder, they also may be plastic (for instance for showplace girders).

The invention is elucidated below by means of drawings of embodiment modes.

Figure 3:
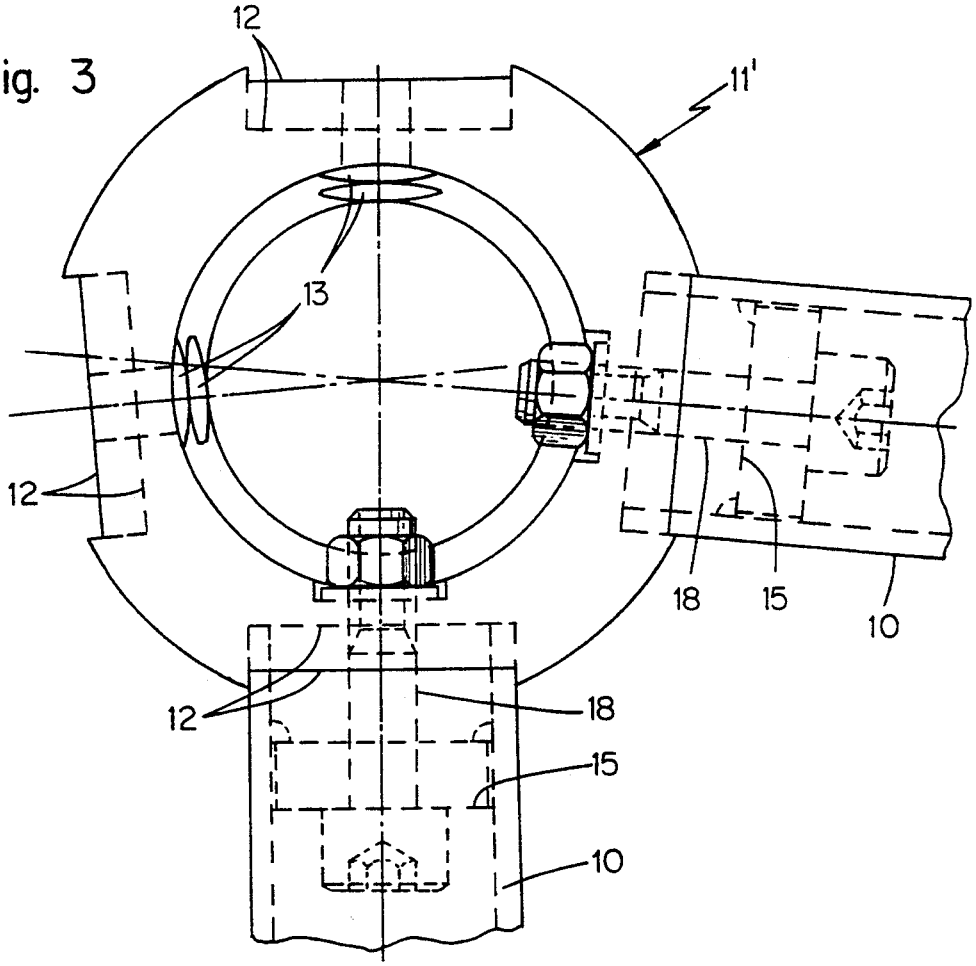
Figure 2:
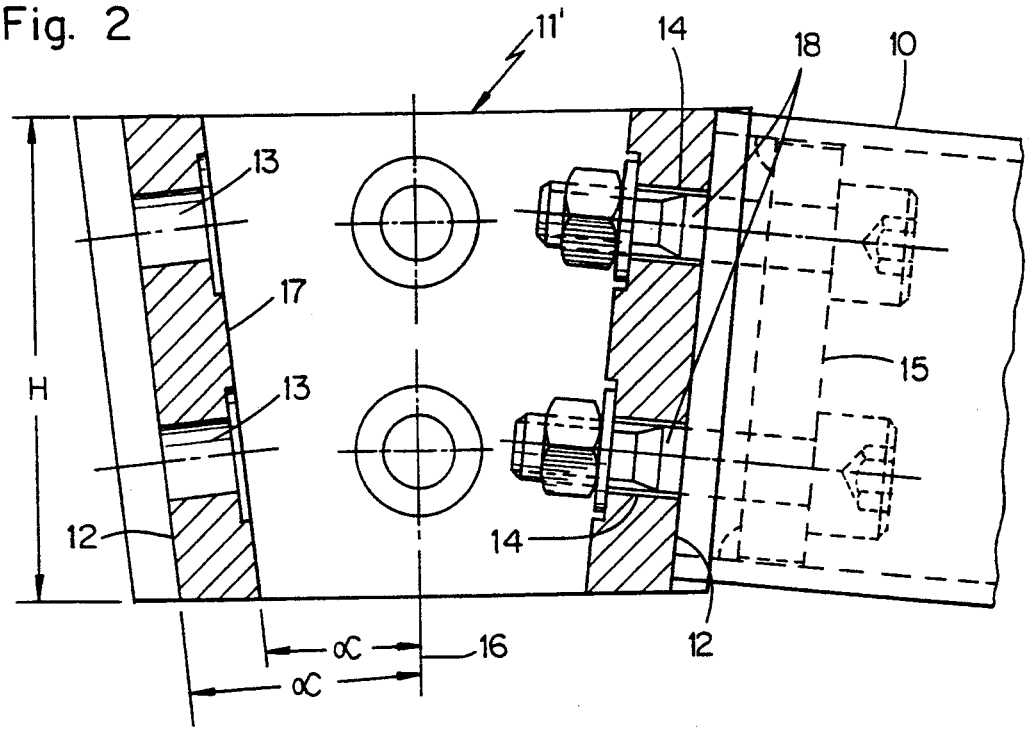
Figure 4:
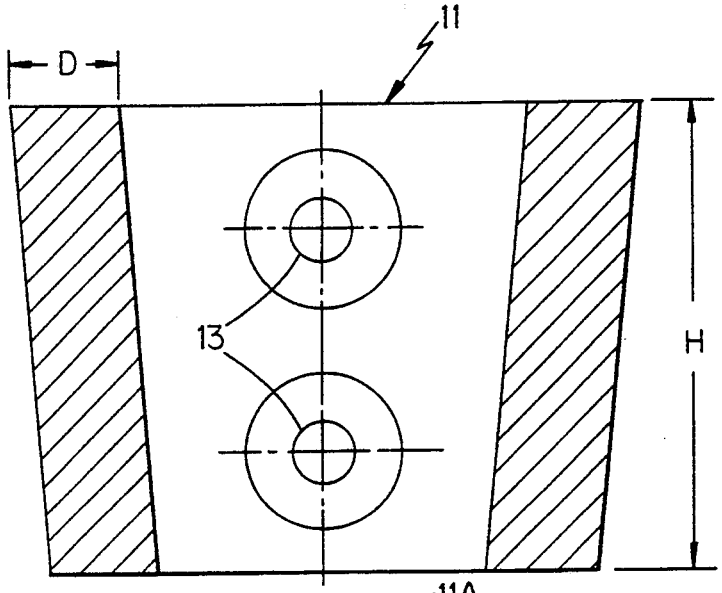
Figure 5:
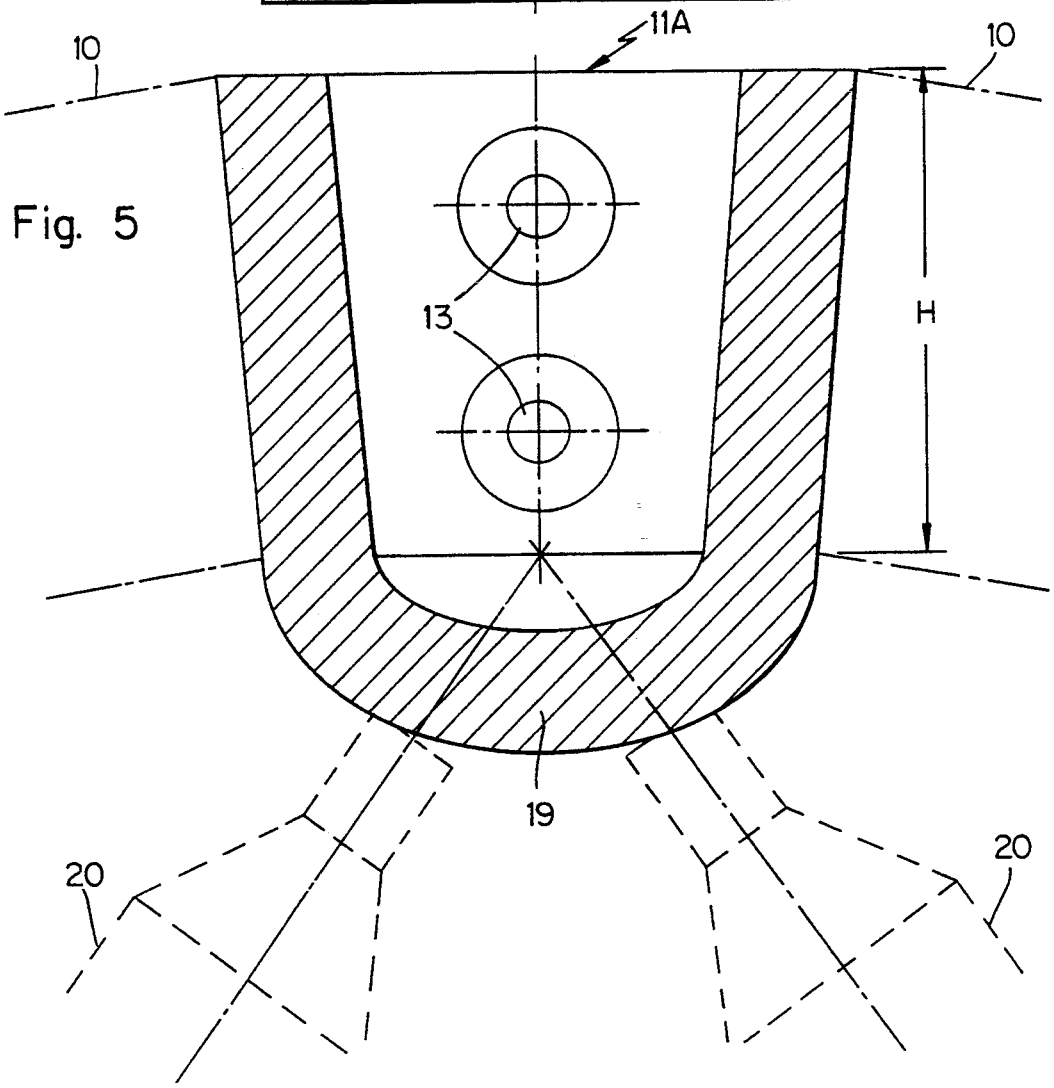
Figure 6:
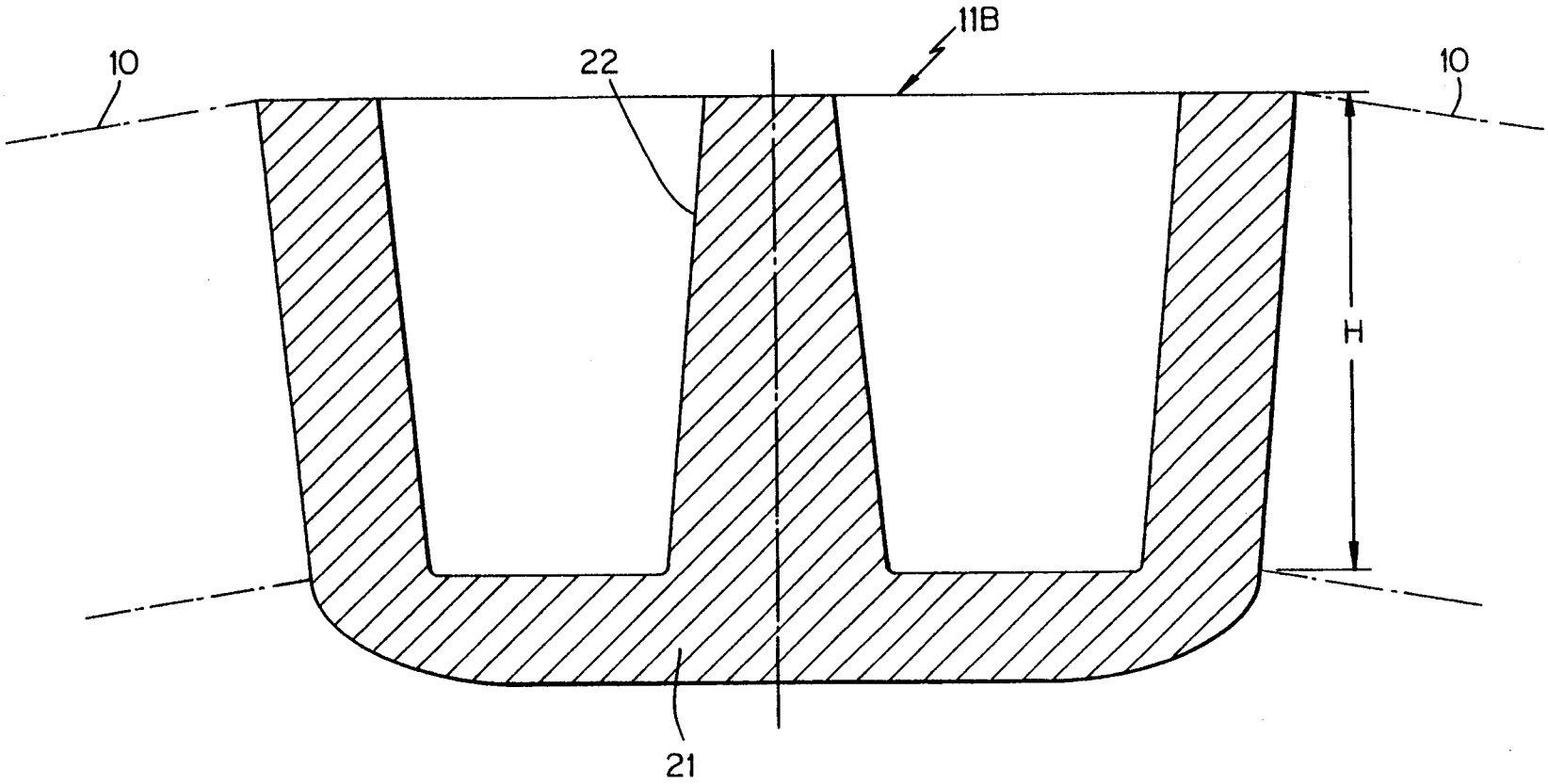

FIG. 1 is a sectional cutaway of a single-layer, doubly curved lattice girder with frusto-conical joint-adapters of the invention, FIG. 2 is a sectional view on an enlarged scale of a joint-adapter similar to those of FIG. 1 connected to a bar of a lattice girder similar to that of FIG. 1 for instance, FIG. 3 is a topview of the joint-adapter of FIG. 2 illustratively with two bars being connected, FIG. 4 is a further sectional view of the frusto-conical joint-adapter of FIGS. 2 and 3, FIG. 5 is a sectional view of a further embodiment mode of the joint-adapter of the invention in the form of a cup adapter, and FIG. 6 is a sectional view of a further embodiment mode of the joint-adapter of the invention in the form of a saucer adapter.

The lattice girder shown in a cutaway in FIG. 1 for (omitted) covering units illustratively is designed for a building dome and comprises frusto-conical joint-adapters 11 to which for instance four bars 10 in the form of rectangular pipes are connected. The joint-adapters 11 are appropriately fitted with plane rest surfaces 12 milled into their outer periphery to support the butt ends of the bars 10. The butt ends of the bars 10 are cut orthogonally to the bar axes.

In the vicinity of each rest surface 12, the joint-adapters 11 illustratively comprise symmetrically located boreholes 13 crossed by affixing bolts omitted from FIG. 1 and passing through boreholes 14 in support plates 15 welded into the ends of the bars 10.

The assembly mode is such in the embodiment mode of FIG. 1 that the rest surfaces 12 for the butt ends of the bars 10 subtend an angle $\alpha$ with the extended joint-adapter main axis 16 differing only slightly from the corresponding angle $\beta$ for instance of the joint-adapter inside wall. Furthermore the wall thickness D of the frusto-conical joint-adapter 11 is constant over its height (FIG. 4). As shown by FIG. 2, the slope angles $\alpha$ of the rest surfaces 12 relative to the extended main joint-adapter axis 16 preferably shall be equal to the slope angle $\alpha$ illustratively of the inside-wall 17 of the joint-adapter 11'. The same components are denoted by the same references in FIGS. 1 and 2. The references 18 denote the affixing bolts fastening the bars 10 to the joint-adapter 11'. FIGS. 1 and 2 moreover show that the slope angle $\alpha$ of the rest surfaces 12 relative to the extended joint-adapter main axis 16 determines the curvature of the lattice girder. The wall thickness of the joint-adapter 11' is constant over its entire height H at its thinnest part in the vicinity of the rest surfaces 12.

The embodiment mode of a joint-adapter 11A shown in FIG. 5 comprises a frusto-conical segment of height H corresponding to the embodiment of FIG. 4 and allowing connection of bars 10 as described above and denoted in FIG. 5 by dash-dot lines. Additionally this joint-adapter 11A is provided with an outwardly convex base 19 and therefore it is also called a cup joint-adapter. The bars 20 of a lower boom shown by dashed lines can be affixed to the base 19 for instance by rotating bolts into corresponding threads in the base 19. Accordingly this adapter joint 11A is suitable for two-layer lattice girders. Omitted covering components may be deposited directly onto the bars 10 forming the upper boom.

The adapter joint 11B shown as a further embodiment mode in FIG. 6 also comprises a frusto-conical segment of height H corresponding to the embodiments of FIGS. 4 and 5 and further it comprises a flat base 21 integral with a projection 22 rising centrally. This joint-adapter 11B is also called a saucer adapter-joint and it is designed for single-layer, doubly-curved lattice girders and it also allows direct deposition of the covering components on the bars 10. Several more bars 10 than for the embodiments of FIGS. 4 and 5 can be affixed to this joint-adapter 11B—for instance from 5 to 10 bars—depending on the particular structure of the lattice girder.

I claim:

1. In a joint adapter for doubly curved lattice girders comprising a hollow integral unit with a plurality of bore holes in said hollow unit for affixing bars of a said lattice girders thereto; said hollow integral unit having rest surfaces in sidewalls thereof, each rest surface receiving a butt end of a said bar; the improvement comprising:

a) said hollow integral unit having a frusto-conical shape; and b) each said rest surface subtending a first slope angle with a main axis of said hollow integral unit that coincides generally with a second slope angle subtended by an inside surface of said hollow integral unit and said main axis, the first slope angle determining a curvature of said lattice girders.

2. The improvement of claim 1 wherein said hollow integral unit includes a base at one end thereof.

3. The improvement of claim 2 wherein said base is cup-shaped.

4. The improvement of claim 2 wherein said base is saucer shaped.

5. The improvement of claim 1 wherein said hollow integral unit has sidewalls in lengthwise cross section having a uniform thickness.

6. The improvement of claim 1 wherein said rest surfaces are recessed in outer sidewalls of said hollow integral unit.

* * * * *